United States Patent [19]

Kramer et al.

[11] 4,193,861

[45] Mar. 18, 1980

[54] PROCESS FOR INSTALLING SYNTHETIC FIBER DIAPHRAGMS IN CHLOR-ALKALI CELL

[75] Inventors: David A. Kramer, Dearborn; Shyam D. Argade, Farmington Hills, both of Mich.; Edward N. Balko, Wilmington, Mass.

[73] Assignee: BASF Wyandotte Corporation, Wyandotte, Mich.

[21] Appl. No.: 1,445

[22] Filed: Jan. 8, 1979

[51] Int. Cl.[2] ..... C25B 13/08

[52] U.S. Cl. ..... 204/296

[58] Field of Search ..... 204/295–296, 204/98, 128; 427/243, 296, 307, 353

[56] References Cited

U.S. PATENT DOCUMENTS

| | | | |
|---|---|---|---|
| 4,012,541 | 3/1977 | Hirozawa | 204/243 |
| 4,081,350 | 3/1978 | Kadija et al. | 204/295 |
| 4,093,533 | 6/1978 | Beaver et al. | 204/295 |

*Primary Examiner*—R. L. Andrews

*Attorney, Agent, or Firm*—John W. Linkhauer; Joseph D. Michaels

[57] ABSTRACT

Initial cell voltages are reduced by decreasing the resistance of the diaphragm through a degassing procedure prior to or at installation thereof. This degassing procedure involves subjecting the diaphragm to subatmospheric pressure while contacting the diaphragm with electrolyte, said electrolyte being an aqueous saline solution having a surface active agent therein in an amount sufficient to reduce the surface tension below the critical surface tension for wetting the fibers, and increasing the pressure to atmospheric or cell working pressure to force electrolyte solution into the interstices of the diaphragm.

23 Claims, No Drawings

PROCESS FOR INSTALLING SYNTHETIC FIBER DIAPHRAGMS IN CHLOR-ALKALI CELL

BACKGROUND OF THE INVENTION

1. Field of the Invention

This invention relates to a process for installing synthetic fiber diaphragms in chlor-alkali cells, and more particularly it relates to such process in which the initial diaphragm resistance is reduced, thereby decreasing the start-up cell voltages.

2. Description of the Prior Art

The use of diaphragms in chlor-alkali cells is well known, and asbestos diaphragms have been used satisfactorily for many years. However, since asbestos is found to be a hazardous material, widespread efforts have been made to utilize substitute materials in the diaphragms. One satisfactory substitute which has been found and is known to the prior art is the use of relatively inert synthetic plastic material which may be formed into small fibers and deposited by known techniques to provide fibrous diaphragms. An example of such a diaphragm is shown in U.S. Pat. No. 4,036,729. Other improvements have been made in the use of these synthetic fibers to make satisfactory diaphragms, involving the use of fluorinated hydrocarbon resins, heat treatments, and the like in order to render the diaphragms more satisfactory.

However, these synthetic fibers are hydrophobic and have presented difficulties not present with hydrophilic asbestos fibers. Accordingly, it is also known to utilize surfactants to render the fiber diaphragms more wettable. Even with these improvements, it takes about two weeks of operation before the diaphragm heretofore in use begins to operate under satisfactory conditions.

U.S. Pat. No. 4,012,541 relates to a diaphragm made with polytetrafluoroethylene film in which it is suggested that air be removed by vacuum when the diaphragm is wetted. However, there is no suggestion of carrying out this step in a brine solution, and forcing conductive brine into the interstices of the diaphragm.

SUMMARY OF THE INVENTION

The present invention involves the discovery of the cause of one of the relatively high resistance start-up problems with such synthetic diaphragms and provides a solution thereto.

In accordance with the invention, a procedure is provided for installing a synthetic fiber diaphragm in chlor-alkali cells whereby a complete diaphragm installation may be made with reduced cell voltages in the start-up procedure. The reduction in start-up voltage is very important, not only because of the large amounts of energy saved, but also because this wasted energy goes to heat in the cell and causes undesirable overheating which must be handled by modifying the operating procedures from the desired operating parameters.

These and other advantages are obtained by utilizing a process for installing synthetic fiber diaphragms in chlor-alkali cells, comprising the steps of subjecting each of the diaphragms to a subatmospheric pressure and immersing the diaphragms in an electrolyte solution having a surface active agent therein capable of reducing the surface tension of the electrolyte below the critical surface tension for wetting the fibrous diaphragm; returning the pressure to atmospheric pressure or cell working pressures while retaining the diaphragms immersed in electrolyte; and keeping the diaphragms wet with electrolyte solution until ready for start-up in a chlor-alkali cell.

Advantageous results are obtained whether the diaphragm is immersed first in the electrolyte and the vacuum drawn, or whether the dry diaphragm is first subjected to vacuum and then wetted while retaining the vacuum. The latter procedure is believed to be preferred in all cases, and is definitely preferred when low-permeability diaphragms are used.

It has been found that the use of the procedure above considerably reduces diaphragm resistance in start-up, and it is believed that this reduced resistance is obtained by removing entrapped gas such as air from within the diaphragm web structure. This procedure may be carried out in a separate container or in the chlor-alkali cell itself. In either event, it is important to keep the diaphragm wet with electrolyte solution from the time it is subjected to the reduced pressure, or degassing, until start-up operation in the chlor-alkali cell wherein the diaphragms are, of course, retained in immersed condition. It is also important to evacuate the diaphragm to at least 200 millimeters mercury absolute, and preferably to about the vapor pressure of the electrolyte solution contacted therewith or slightly lower. The actual vapor pressure of the electrolyte solution will, of course, vary with the temperature of the solution, and when working at the vapor pressure of the solution, the solution will cool as water evaporates therefrom, thereby lowering the vapor pressure. It is also preferred to utilize certain classes of synthetic fiber diaphragms which will be more fully described hereinafter.

DESCRIPTION OF THE PREFERRED EMBODIMENTS

As hereinafter noted, the present invention contemplates a process for installing a synthetic fiber diaphragm in chlor-alkali cells. As used herein, the term "synthetic fiber" diaphragm is construed to mean a diaphragm in which the major portion thereof was composed of synthetic resinous material capable of withstanding the internal conditions of the chlor-alkali cell and made from hydrophobic thermoplastic material.

In its broad aspect, suitable thermoplastic fibers contemplated herein include polyolefin, polycarbonates, polyesters, polyamides, and the like as well as mixtures thereof. Representative examples of these types of compounds are polyethylene, polypropylene, hexamethylene adipamide and other nylons, polyethylene terephthalate, poly-4-methylpentene-1, poly(tetramethylene)terephthalate, polystyrene, polyvinylidene copolymers, polycarbonates of 2-(4-hydroxymethyl)-propane(bisphenol A), polyphenylene oxide and the like, polyaerosol foams, as well as mixtures thereof.

A preferred class of thermoplastic fibers contemplated for use herein is the fluorinated hydrocarbons, and in particular fluorinated polyalkylenes. The fluorinated polyalkylenes can be additionally halogen-substituted fluorinated polyalkylenes. Representative of the fluorinated hydrocarbons are polytetrafluoroethylene, fluorinated ethylenepropylene copolymers, polychlorotrifluoroethylene, polyvinylidene fluoride, polyethylenechlorotrifluoroethylene, polyethylenetetrafluoroethylene and tetrafluoroethylene perfluorovinyl ether sulfonylfluoride copolymers. Most preferred, are the homopolymer of chlorotrifluoroethylene, and a copolymer containing chlorotrifluoroethylene and vinylidene fluoride with at least 80 percent of the copolymer being chlorotrifluoroethylene. It is also possible to use these polymeric fibers along with minor amounts of other fibers such as asbestos, potassium titanate, glass, silica, zirconia fibers and silicate, borate and phosphate fibers.

In general, the synthetic fibers may be prepared by the procedures given in U.S. Pat. No. 4,036,729 or for the preferred fibers by the procedure given in U.S. Pat. No. 4,126,535, the disclosures of which are incorporated herein by reference.

Thus, the chemical content of one of the preferred fibers to be utilized is a composition based upon a copolymer of, on the average, 24 molecular units of chlorotrifluoroethylene and one molecular unit of vinylidene fluoride. Such material is commercially available from Allied Chemical Co. under the name "Aclon 2000". Another preferred fiber is made from the homopolymer of chlorotrifluoroethylene sold by 3M Company as "Kel-F 81".

Such material is put into the form of fibers having a cross section on the order of 0.1 micron by 10 microns and the length of approximately 0.1 to 10 millimeters in accordance with a modification of a process which is adequately described in Belgium Pat. No. 795,724. The surface area of such fibers is five to 20 square meters per gram as measured by nitrogen adsorption. There is thus produced material which is, in effect, water-soaked fiber bundles, containing 80 to 90 percent by weight water, made by draining the output of the process conducted according to the above-mentioned Belgian patent on a perforated moving bed.

As is known to those skilled in the art, fluorinated hydrocarbon fibers, per se, are difficult to disperse in an aqueous medium, thereby rendering such fibers difficult to deposit on a cathode screen or support. Thus, it is customary to add a surfactant and disperse the fibers in an aqueous medium. The surfactant is employed in amount ranging from about 0.01 percent to about ten percent, by weight, based on weight of the slurry all of which is shown in the prior art.

The slurry is then vacuum-deposited on a cathode screen by any suitable method. A particularly preferred method of depositing slurry involves the immersion of the cathode screen, mounted in a vacuum box, into the slurry, which is maintained in the state of agitation. Then, a series of increasing partial vacuums are applied across the screen for a period of time followed by a full vacuum for a predetermined period of time. Screen having the fibers deposited thereon is, then, dried at a temperature of about 100° C. for about one to three hours to evaporate the water. The diaphragm is now ready to be installed in a chlor-alkali cell in accordance with the present invention.

The dried diaphragm together with the cathode screen upon which it is deposited is immersed in an electrolyte solution. This electrolyte solution may be similar in composition to the saline solution to be treated in the chlor-alkali cell, and may contain anywhere from say 10 to 30 percent, by weight, of sodium chloride. Preferably, the amount of sodium chloride is about 25 percent by weight. In addition, the electrolyte has incorporated therein a surface-active agent which is present in an amount sufficient to reduce the surface tension of the aqueous phase below the critical surface tension for wetting of the polymer. For the preferred Aclon fibers, the critical surface tension is 32.6 dynes per centimeter. Suitable surface-active agents include both nonionic and anionic surfactants. Useful nonionic surfactants include the oxyalkylene condensates of ethylenediamine, such as ethylene oxide, propylene oxide, block copolymers prepared by the sequential addition thereof to ethylenediamine, which are described in U.S. Pat. No. 2,979,528. Other useful organic surfactants include polyoxyethylene alkylphenols, polyoxyethylene alcohols, polyoxyethylene esters of fatty acids, polyoxyethylene mercaptans, polyoxyethylene alkylamines, polyoxyethylene alkyl amides, polyol surfactants and the like. The preferred surfactant is a product made by the Minnesota Mining and Manufacturing Corporation and sold as "Fluorad FC170". This surfactant is effective at a one gram per liter level in a solution containing 300 grams per liter (30 percent by weight) of salt.

The diaphragm is subjected to a subatmospheric pressure as well as being immersed in electrolyte. The order of these steps is not critical, but it is preferred to subject the diaphragm to subatmospheric pressure prior to immersion in the electrolyte in order to remove most of the air before it is surrounded by electrolyte. In this sequence, it is also preferred to subject the electrolyte solution to a vacuum before and during its addition to the container having the diaphragm therein. In general, it will be advantageous to utilize a pressure reduction below about 20 centimeters of mercury absolute, with the practical lower limit being at about the vapor pressure of the electrolytic solution. This vapor pressure will vary depending upon the temperature of the solution and be say from about 20 to 30 millimeters although lower pressures may be used. The amount of time required for substantially complete air removal will vary somewhat depending upon the pressure reduction and will generally be in the range of about five minutes to about one hour. When operating at or near the vapor pressure of the electrolyte at ambient temperatures, times of about ten minutes are found to be quite satisfactory, and this is the preferred area of operation.

After the diaphragm has been subjected to subatmospheric pressure and immersed for a sufficient time, the pressure is returned to atmospheric pressure while retaining the diaphragm immersed in the electrolyte. This treatment may take place in a separate container. Alternatively, where the diaphragm is already placed in the cell prior to subjecting same to subatmospheric pressure, the pressure may be returned to a suitable cell working pressure. However, in either event, it is important to keep the diaphragm wet with electrolyte solution from the time the diaphragm is brought up from subatmospheric pressure up until start-up in a chlor-alkali cell and, of course, during the operation of the cell. When the pressure is increased back to atmospheric or working pressure, electrolyte is forced into the diaphragm pores so as to increase the initial conductance of the diaphragm. Thus, it is important to retain the diaphragm wet so that this electrolyte will remain in the pores after the gasses have been removed therefrom by the vacuum step herein.

The invention is further illustrated by the following specific examples, in which parts are given by weight unless otherwise designated, and which are to be taken as illustrative only and not in a limiting sense.

EXAMPLE 1

A diaphragm was made and processed according to the present invention, and tested to determine the change in electrical resistance as compared to a diaphragm prepared in accordance with the prior art. The composition of the diaphragm was "Aclon 2000" polymer. The average cross-sectional dimensions of the fibers used to form the diaphragm were one micron by four microns, with a length of 0.25 to 0.5 millimeters. Such fibers were suspended in water, to the extent of 12.7 grams per liter (dry weight of fiber employed), along with four grams per liter of dioctyl sodium sulfosuccinate and two grams per liter of a fluorine-containing surfactant, namely, that sold by 3M Company under the designation FLUORAD "FC-170".

Fiber dispersion and slurry agitation were performed with the use of a propellor-type mechanical agitator driven by a "Lightnin" mixer.

A two-layered web was formed by drawing two successive volumes of slurry through a cathode screen at a ratio of 8.3 milliliters of slurry per square centimeter of screen area per layer according to the following schedule: two minutes at 25 millimeters of mercury difference from atmospheric pressure, three minutes further at 50 millimeters of mercury difference in pressure, and two minutes further at 100 millimeters of mercury difference in pressure.

The second layer was then applied: three minutes at 50 millimeters of mercury difference from atmospheric pressure, eight minutes further at 100 millimeters of mercury difference in pressure, and two minutes further at 150 millimeters of mercury difference in pressure. The full vacuum of 615 millimeters of mercury was then applied for 20 minutes. There was obtained a diaphragm having a gross thickness of 2.7 millimeters and having a permeability coefficient of $1.7\times10^{-9}$ square centimeters. After being dried at 110° C. for 16 hours, one of such diaphragms was checked for its resistance factor. Another of such diaphragms was processed further in accordance with the invention.

The second diaphragm was treated according to the invention by immersing the diaphragm in a container having an electrolyte solution therein. The electrolyte solution contained brine at a concentration of 300 grams per liter of solution and a surfactant in a concentration of one gram per liter of solution. The surfactant used was the BASF Wyandotte Corporation product "Plurafac RA-40". The immersed diaphragm was then subjected to reduced pressure by evacuating means which brought the atmosphere over the electrolyte to about the vapor pressure thereof. This pressure was held for ten minutes, and during this time, entrapped air expanded and left the diaphragm. The pressure was then returned to atmospheric pressure with the diaphragm retained in immersed position in electrolyte, and this forced liquid into the diaphragm pores. The wet diaphragm was then checked for electrical resistance. The resistance factor determined in the test is defined as the ratio of the diaphragm resistance when flooded with electrolyte to that of an identical volume of the same electrolyte. The diaphragm which was not subjected to the treatment according to the invention, had a resistance factor of 51.1 and diaphragm which was treated in accordance with the procedure of the invention had a resistance factor of 4.3.

EXAMPLE 2

The procedure of Example 1 was repeated except that the fiber was made with the fiber of Example 1 which also incorporated a smal amount of zirconia fiber therein. The test showed that the samples which were not treated according to the invention had a resistance factor of 87.2 whereas the diaphragm which was treated according to the invention had a resistance factor of 8.1.

EXAMPLE 3

Two diaphragms were prepared according to the method described in Example 1 with one of the diaphragms installed in a chlorine cell without any vacuum treatment, and the other diaphragm installed in a chlorine cell in accordance with the invention. In each case, the cell was filled with brine and cell current was started. With the first diaphragm, the diaphragm resistance was 628 ohms per square centimeter, or, expressed alternately, cell voltage was 7.99 volts at 8.9 milliamperes per square centimeter current density at 20° C. A fluorocarbon surfactant 3M product "FC-170" was added to the anolyte compartment at a level of five grams per liter. Cell voltage dropped to 6.07 volts at 8.9 milliamperes per square centimeter and 20° C., or a resistance of approximately 412 ohms per square centimeter. As opposed to this, the second diaphragm installed in a chlorine cell in accordance with the invention had an initial cell voltage of 3.87 volts at 160 milliamperes per square centimeter and 20° C., or a diaphragm resistance of 9.2 ohms per square centimeter.

EXAMPLE 4

A series of diaphragms was prepared according to the procedure of Example 1 above, except that a single layer of diaphragm was made and the surfactant used was "Plurafac RA-40" alone. The thickness and permeability of each of the diaphragms are given in Table 1 below along with test data. Each of the diaphragms was placed in a vacuum container and evacuated to a vacumm of about 29 inches mercury absolute. An electrolyte solution, 0.1 N sodium sulfate having 1 gram per liter of surfactant Fluorad FC170 was also subjected to a vacuum, and then the electrolyte was added to the container to immerse the diaphragm while retaining the vacuum. The vacuum was held for about 10 minutes and then released while retaining the diaphragm in immersed condition. The resistance factor of the degassed diaphragm was measured. For the sake of comparison, the diaphragm was dried, and then soaked by immersion in the electrolyte solution of this example for 16 hours. The resistance factor of the soaked diaphragm was measured. These data are given in Table I below.

Table 1

| Diaphragm Thickness (mm) | Diaphragm Permeability ($\times10^{-9}$cm$^2$) | Resistance Factor Degassed Diaphragm | Resistance Factor Soaked Diaphragm |
|---|---|---|---|
| 1.87 | 0.070 | 5.96 | 7.74 |
| 1.45 | 0.043 | 7.39 | 8.52 |
| 3.2 | 1.16 | 3.86 | 36.24 |
| 3.4 | 2.84 | 2.29 | 27.37 |
| 1.19 | 0.125 | 11.65 | 20.59 |

From the data given in Table I above, the advantages of the procedure of the invention as compared to soaking the diaphragm for start-up preparation are obvious. The advantages of the invention are particularly notable with thicker diaphragms.

EXAMPLE 5

A pair of low-permeability diaphragms were degassed in accordance with the procedure of Examples 1 and 4 above. The first diaphragm had a permeability of $0.100\times10^{-9}$ cm$^2$, and the second diaphragm had a permeability of $0.104 \times 10^{-9}$ cm$^2$. The resistance factors were measured, and are given in Table II below.

Table II

| | Resistance Factor (Degassed by Procedure of Example 1) | Resistance Factor (Degassed by Procedure of Example 4) |
|---|---|---|
| First Diaphragm | 12.84 | 11.3 |
| Second Diaphragm | 17.32 | 10.0 |

From the above data, it is seen that the procedure of Example 4 is preferred, at least for diaphragms having a low permeability.

From the above description, it is seen that when utilizing the diaphragm installed in accordance with the invention, it is possible to utilize considerably higher current densities at considerably lower voltages at the start-up of the cell. In this way, serious start-up problems heretofore encountered in this type of chlor-alkali cell have been overcome.

The embodiments of the invention in which an exclusive property or privilege is claimed are defined as follows:

1. A process for installing a synthetic fiber diaphragm in chlor-alkali cells, comprising the steps of
   subjecting the diaphragm to a subatmospheric pressure lower than about 200 millimeters of mercury absolute,
   contacting the diaphragm before or after the diaphragm is subjected to reduced pressure to an electrically conductive electrolyte solution consisting essentially of water, 10 to 50 percent by weight of electrolyte, and an amount of surfactant sufficient to reduce the surface tension of the electrolyte solution to below the critical surface tension for wetting the fibrous diaphragm,
   increasing the pressure while retaining the diaphragm immersed in electrolyte to force electrolyte into the interstices of the fiber diaphragm, and
   keeping the diaphragm wet with electrolyte solution until ready for start-up in a chlor-alkali cell.

2. A process as defined in claim 1, wherein a major portion of the fibers are composed of an addition polymer selected from the group consisting of homopolymers of chlorotrifluoroethylene and a copolymer containing chlorotrifluoroethylene and at least one compatible unsaturated $C_2$ to $C_4$ monomer, units of the chlorotrifluoroethylene accounting for at least 80 percent of the monomeric units of said copolymer.

3. A process as defined in claim 2, wherein the addition polymer is a copolymer containing chlorotrifluoroethylene and vinylidene fluoride.

4. A process as defined in claim 3, wherein the addition polymer contains about one monomer unit of vinylidene fluoride per twenty-four monomer units of chlorotrifluoroethylene.

5. A process as defined in claim 1, wherein the diaphragm is a homopolymer of chlorotrifluoroethylene.

6. A process as defined in claim 1, wherein the subatmospheric pressure is at about the vapor pressure of the electrolyte.

7. A process as defined in claim 1, in which the electrolyte solution consists essentially of water, about ten to thirty percent by weight of sodium chloride, and an amount of surfactant sufficient to reduce the surface tension of the solution to about 32.6 dynes/centimeter or less.

8. A process for installing a synthetic fiber diaphragm in chlor-alkali cells, comprising the steps of
   retaining the diaphragm and an electrically conductive electrolyte solution at a subatmospheric pressure lower than about 200 milllimeters mercury absolute for a time sufficient to remove entrapped air,
   immersing the diaphragm in an electrolyte solution having a surface active agent therein capable of reducing the surface tension of the electrolyte below the critical surface tension for wetting the fibrous diaphragm,
   said electrolyte solution also being subjected to a subatmospheric pressure lower than about 200 millimeters absolute prior to, during, and after the immersion step,
   returning the pressure to atmospheric pressure or cell working pressures while retaining the diaphragm immersed in electrolyte, and
   keeping the diaphragm wet with electrolyte solution until ready for start-up in a chlor-alkali cell.

9. A process as defined in claim 8, wherein a major portion of the fibers are composed of an addition polymer selected from the group consisting of homopolymers of chlorotrifluoroethylene and copolymers of chlorotrifluoroethylene and at least one compatible unsaturated $C_2$ to $C_4$ monomer, units of the chlorotrifluoroethylene accounting for at least 80 percent of the monomeric units of said copolymer.

10. A process as defined in claim 9, wherein the addition polymer is a copolymer containing chlorotrifluoroethylene and vinylidene fluoride.

11. A process as defined in claim 10, wherein the addition polymer contains about one monomer unit of vinylidene fluoride per twenty-four monomer units of chlorotrifluoroethylene.

12. A process as defined in claim 9, wherein the addition polymer is a homopolymer of chlorotrifluoroethylene.

13. A process as defined in claim 8, wherein the subatmospheric pressure is at about the vapor pressure of the electrolyte.

14. A process as defined in claim 8, in which the electrolyte solution consists essentially of water, about ten to thirty percent by weight of sodium chloride, and an amount of surfactant sufficient to reduce the surface tension of the solution to about 32.6 dynes/centimeter or less.

15. A process for installing a synthetic fiber diaphragm in a chlor-alkali cell, comprising the steps of
   placing the diaphragm in position in the cell,
   subjecting the diaphragm to a subatmospheric pressure of the order of 10 to 200 millimeters mercury absolute,
   subjecting an electrically conductive aqueous electrolyte solution to a subatmospheric pressure of the order of the vapor pressure of the solution to about 200 millimeters mercury absolute,
   said aqueous electrolyte containing a surfactant in an amount sufficient to reduce the surface tension of the electrolyte solution below the critical surface tension for wetting the fibrous diaphragm,
   adding the electrolyte to the cell to about the desired operating level therein while retaining the subatmospheric pressures,
   retaining the immersed diaphragm at the subatmospheric pressure of the order of the vapor pressure of the solution to about 200 millimeters mercury absolute for from about five minutes to one hour, and returning the pressure to atmospheric pressure or cell working pressure while retaining the diaphragm in working position in the electrolyte.

16. A process for installing a synthetic fiber diaphragm in a chlor-alkali cell comprising the steps of immersing the diaphragm in an electrolyte solution in a container equipped to be subjected to reduced pressure, with the electrolyte solution being an aqueous brine solution having a surface active agent therein in an amount sufficient to reduce the surface tension of the electrolyte solution below the critical surface tension for wetting the fibrous diaphragm, subjecting the immersed diaphragm to a subatmospheric pressure of the order of the vapor pressure of the solution to 200 millimeters mercury absolute for a period of from about five minutes to one hour, returning the pressure to atmospheric pressure while retaining the diaphragm immersed in the electrolyte solution, and moving the diaphragm to position in the chlor-alkali cell with the diaphragm kept wet during the moving step and until put in use in the cell.

17. A process as defined in claim 16, wherein a major portion of the fibers are composed of an addition polymer selected from the group consisting of homopolymers of chlorotrifluoroethylene and copolymers of chlorotrifluoroethylene with at least one compatible unsaturated $C_2$ to $C_4$ monomer, units of the chlorotrifluoroethylene accounting for at least 80 percent of the monomeric units of said copolymer.

18. A process as defined in claim 17, wherein the addition polymer is a copolymer containing chlorotrifluoroethylene and vinylidene fluoride.

19. A process as defined in claim 18, wherein the addition polymer contains about one monomer unit of vinylidene fluoride per twenty-four monomer units of chlorotrifluoroethylene.

20. A process as defined in claim 17, wherein the addition polymer is a homopolymer of chlorotrifluoroethylene.

21. A process as defined in claim 16, wherein the sub-atmospheric pressure is at about the vapor pressure of the electrolyte.

22. A process as defined in claim 16, in which the electrolyte solution consists essentially of water, about ten to thirty percent by weight of sodium chloride, and an amount of surfactant sufficient to reduce the surface tension of the solution to about 32.6 dynes/centimeter or less.

23. A process for installing a synthetic fiber diaphragm in a chlor-alkali cell, comprising the steps of placing the diaphragm in position in the cell, adding an aqueous saline electrolyte solutin to the cell to about the desired operating level therein, adding a surfactant to the electrolyte solution in an amount sufficient to reduce the surface tension of the electrolyte solution below the critical surface tension for wetting the fibrous diaphragm, subjecting the immersed diaphragm to a subatmospheric pressure of the order of the vapor pressure of the solution to about 200 millimeters mercury absolute for from about five minutes to one hour, and returning the pressure to atmospheric pressure or cell working pressure while retaining the diaphragm in working position in the electrolyte.

* * * * *